US005630437A

United States Patent [19]

Dries et al.

[11] Patent Number: 5,630,437

[45] Date of Patent: May 20, 1997

[54] DISHWASHER WITH DOWNWARD OPENING PUMP INLET MOUTH FOR IMPROVED OPERATION

[75] Inventors: John E. Dries; James M. Edwards, both of Kinston, N.C.

[73] Assignee: White Consolidated Industries, Inc., Cleveland, Ohio

[21] Appl. No.: 664,795

[22] Filed: Jun. 17, 1996

Related U.S. Application Data

[63] Continuation of Ser. No. 420,674, Apr. 12, 1995, abandoned.

[51] Int. Cl.[6] ..... A47L 15/42

[52] U.S. Cl. ..... 134/186; 134/191; 134/195; 137/387; 137/563

[58] Field of Search ..... 134/104.1, 111, 134/178, 186, 191, 195; 68/208, 18 F; 137/563, 565, 187

[56] References Cited

U.S. PATENT DOCUMENTS

| | | | |
|---|---|---|---|
| 2,621,505 | 12/1952 | Smith | 134/111 X |
| 3,078,858 | 2/1963 | Jacobs et al. | 134/186 X |
| 4,150,680 | 4/1979 | Johnson et al. . | |
| 4,467,627 | 8/1984 | Platt et al. | 68/208 X |
| 4,741,357 | 5/1988 | Battel et al. . | |
| 4,848,382 | 7/1989 | Bertsch et al. . | |
| 5,010,920 | 4/1991 | Tolf et al. . | |
| 5,031,427 | 7/1991 | Pastryk et al. | 68/208 |
| 5,493,745 | 2/1996 | Hauch | 68/208 X |

FOREIGN PATENT DOCUMENTS

| | | | |
|---|---|---|---|
| 2425228 | 1/1980 | France | 134/191 |
| 2556480 | 6/1977 | Germany | 134/104.1 |
| 730992 | 6/1955 | United Kingdom | 134/111 |

*Primary Examiner*—Philip R. Coe

*Attorney, Agent, or Firm*—Pearne, Gordon, McCoy & Granger

[57] ABSTRACT

A dishwasher is provided with a flapper valve for directing water from a recirculation pump to spray arms or a drain. The valve is spring biased toward a recirculate position and solenoid operated to a drain position. An inlet of the pump is provided with a downwardly curved suction pipe having a generally horizontal bell mouth. The dishwasher has a sump separated into a pump chamber and a collection chamber. The pump inlet is located in the pump chamber and has a mouth that is located below a level of the bottom of the collection chamber. Wash liquid is pumped through a venturi in the collection chamber to a drain.

15 Claims, 2 Drawing Sheets

DISHWASHER WITH DOWNWARD OPENING PUMP INLET MOUTH FOR IMPROVED OPERATION

This is a continuation of application Ser. No. 08/420,674, filed Apr. 12, 1995, now abandoned.

BACKGROUND OF THE INVENTION

1. Field of the Invention

This invention relates generally to the field of dishwashers and specifically to an improved diverter valve and pump inlet assembly therefor.

2. Description of the Related Art

Dishwashers, particularly those used in domestic applications, have a wash chamber conventionally provided with a sump at a lower part of the wash chamber. Wash liquid sprayed on dishes and other objects in the wash chamber flows downwardly into the sump where the liquid collects. Wash liquid in the sump is recycled to be sprayed on the dishes or directed toward a drain. In some installations, separate pumps (a recycling pump and a drain pump) are used to direct the liquid to the appropriate locations. In other installations, a single pump is be used in conjunction with a valve system to direct the liquid to either the drain or the washing chamber. An example of this is shown in U.S. Pat. No. 4,848,382 to Bertsch, incorporated herein by reference.

The pumps used in dishwashers have different inlet configurations. In some cases, the inlet has a downwardly facing mouth, as shown, for example, in U.S. Pat. Nos. 4,150,680, to Johnson, U.S. Pat. No. 4,741,357 to Battel, and U.S. Pat. No. 5,010,920 to Tolf.

The sump of the dishwasher can be divided into separate chambers by a filter. The pump inlet is located in one of these chambers. The pump can be used to drain both chambers. Nearly total evacuation of both chambers is desired.

A diverter valve, such as a solenoid operated flapper valve, can be used to direct the flow of liquid from the pump. It is important for the flapper to properly seal to prevent leakage of liquid into the wrong conduit. In some cases, the valve is spring biased toward a drain position, for example. Sealing of the flapper can be accomplished by pressure of the liquid flowing past the flapper. Water remaining in the pump and valve can prevent the valve from switching. Subsequent flow through an improperly switched valve can seal the flapper in the wrong position thereby causing improper flow of liquid through the valve.

Dishwashers using a single pump with a diverter valve provide advantages of efficiency and simplicity. Accordingly, an improved means of ensuring proper sealing and switching of the diverter valve is desired. This can be accomplished in accordance with the present invention as described herein.

SUMMARY OF THE INVENTION

The present invention provides a washer including a washing chamber adapted to contain objects to be washed. A sump has first and second sump chambers in communication with the washing chamber and adapted for collecting washing liquid from the washing chamber. The first sump chamber has a bottom wall. A pump is in communication with the sump, and a drain conduit is communicable with a drain. A delivery conduit is adapted to spray washing liquid from the second sump chamber into the washing chamber. A diverter valve for diverting washing liquid from the pump to a selected one of the drain conduit and delivery conduit is sealed by water pressure created by the pump. An inlet of the pump is disposed in a vertical plane. A suction pipe communicates with the inlet and has a mouth disposed in a generally horizontal plane in a lower part of the second chamber below a level of the bottom wall of the first chamber.

The valve is a flapper that is spring biased toward a position for diverting the liquid to the drain conduit. The suction pipe is downwardly directed and has bell mouth and an elbow. The inlet is in disposed in a generally vertical plane. A filter is disposed between the first and second sump chambers. The first sump chamber defines a collection chamber for collecting debris from the washing chamber. The bottom wall of the first sump chamber is disposed in a generally horizontal plane. The bottom wall of the first sump chamber is disposed above a bottom wall of the second sump chamber.

DESCRIPTION OF THE PREFERRED EMBODIMENTS

Figure 1:
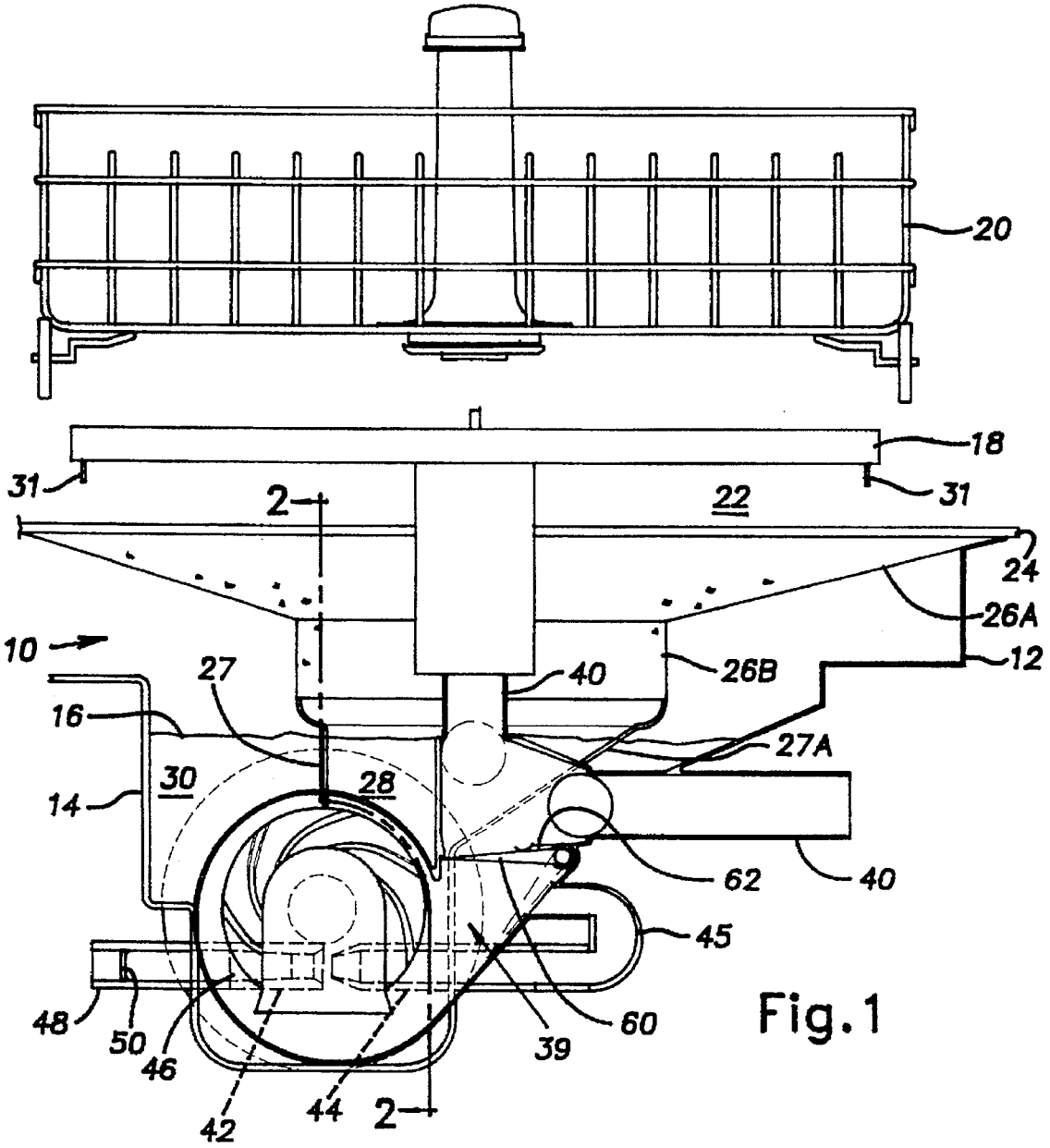
FIG. 1 is a partial elevational view of a dishwasher showing a sump and pump according to the invention.

Referring to FIG. 1, a dishwasher 10 includes a molded plastic tub 12 having a sump 14 molded therein. The sump 14 collects and holds wash liquid 16 that is sprayed from one or more spray arms 18 onto objects held in a rack 20 inside a wash chamber 22. The wash liquid 16 returns from the wash chamber 22 by force of gravity to the sump 14. A coarse filter 24, such as a grate, is disposed between the wash chamber 22 and the sump 14 to prevent flatware an other large objects from entering the sump 14. A fine filter 26 having a sloped, generally horizontal filter component 26A and an annular vertical filter component 26B is disposed in the sump 14 below the coarse filter 24. The fine filter 26 is preferably a molded mesh screen having 4 mm (0.015 in.) openings. An inner wall 27 of the sump 14 defines an extension of the fine filter 26 and separates the sump 14 into a first chamber, referred to as a collection chamber 28 or quiet chamber, and a second chamber, referred to as a pump chamber 30, having a bottom wall 29. The horizontal filter component 26A and a generally horizontal component 27A of the inner wall are sloped downwardly toward the collection chamber 28 to "funnel" food particles from the wash chamber 22 into the collection chamber. Wash liquid flows downwardly through the horizontal component 26A into the pump chamber 30. The fine filter 26 and inner wall 27 isolate the pump chamber 30 from the wash chamber 22 so that food particles and other material in the wash liquid are filtered out before the wash liquid enters the pump chamber 30. In one embodiment of the invention, the horizontal filter component 26A is located directly below the wash arm 18. The wash arm is then provided with a spray nozzle 31 adapted to direct wash liquid at the filter 26A and propel food particles toward the collection chamber 28. Other filter and wall arrangements that filter wash liquid and collect food particles in a chamber are also suitable for the present invention. Food particles are retained in the collection chamber 28 and macerated therein. When the liquid level is high enough, some of the wash liquid in the collection chamber 28 flows through the vertical component 26B into the pump chamber 30. In one embodiment of the invention, an additional component of the fine filter can be provided in the inner wall 27 at a lower part of the collection chamber to permit liquid flow from the bottom of the collection chamber into the pump chamber.

Figure 2:
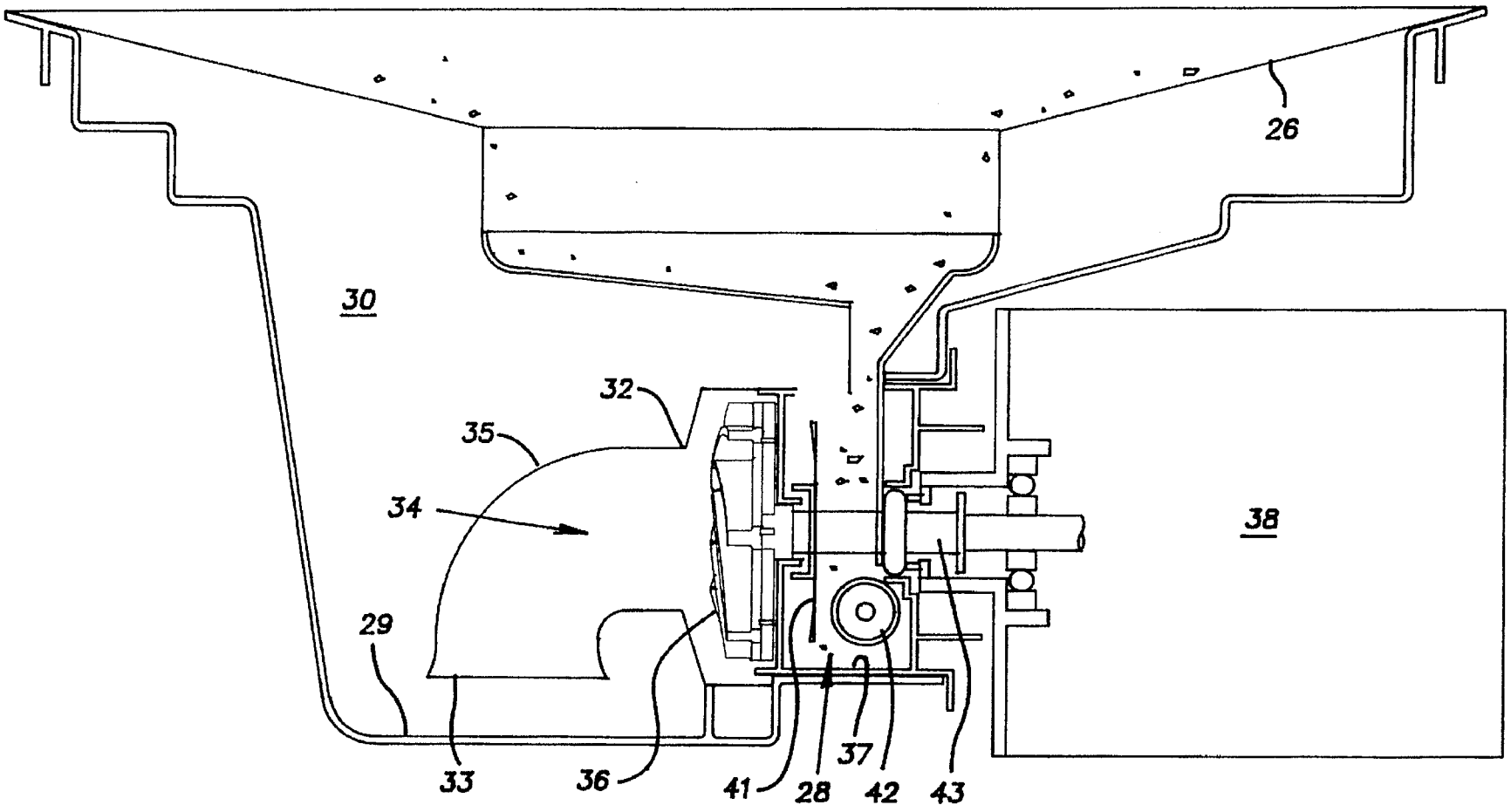
FIG. 2 is an elevational view in a section taken from line 2—2 of FIG. 1.

Referring to FIG. 2, the pump chamber 30 communicates with an inlet 32 of a pump 34 having an impeller 36 driven by a motor 38. The pump inlet 32 communicates with a mouth 33 defined by an intake end of a suction pipe 35. Preferably, the suction pipe 35 has a constant inside diameter or is slightly tapered from the mouth 33 to the inlet 32 to prevent excessive turbulence and formation of air pockets. The mouth 33 is preferably bell shaped and defines a substantially horizontal plane disposed at or below the level of a bottom wall 37 of the collection chamber 28 or below the lowest level at which communication between the collection chamber 28 and pump chamber 30 occurs. The plane defined by the mouth 33 is close to the bottom wall 29 of the pump chamber 30 and spaced therefrom for permitting flow of wash liquid into the suction pipe and preventing clogging. The suction pipe 35 should also have a smoothly curved elbow, with no sharp bend, and should have no internal part extending above the connection to the inlet 32. A mincing blade 41 is disposed on a shaft 43 driven by the motor 38. The blade 41 chops the food particles in the collection chamber 28.

Referring to FIG. 1, an outlet 39 of the pump 34 is in communication with one or more delivery conduits 40. The pump 34 moves wash liquid 16 from the pump chamber 30 through the conduit 40 to the spray arm 18. A venturi 42 has a inlet 44 in communication with the pump outlet 39 through a U-pipe 45. An outlet 46 of the venturi 42 communicates with a drain pipe 48 through a check valve 50. A flapper-type diverter valve 60 operated by a solenoid 64 selectively connects the pump outlet 39 to the wash arm conduits 40 or the venturi 42. The valve 60 is biased toward a recirculate position (shown in phantom in FIG. 1) by a spring 62.

During a wash operation, the diverter valve 60 is in the recirculate position. Wash liquid 16 from the pump chamber 30 is pumped through the conduit 40 and out of the spray arm 18 onto objects being washed. The wash liquid 16 flows down through the coarse filter 24 into the sump 14. Objects and large food particles are filtered by the coarse filter 24. The large food particles will eventually be eroded and dissolved until they pass through the coarse filter. The wash liquid continues flowing downwardly through the fine filter 26, which filters most of the food particles. The filtered wash liquid flows into the pump chamber 30, from where it is recirculated through the wash arm 18 by the pump 34. The proximity of the mouth 33 to the bottom wall 29 permits a relatively small amount of wash liquid to be used without breaking suction to the pump 34. Food particles tend to move down the sloped horizontal component 26A of the fine filter 26 and the horizontal component 27A of the inner wall 27 toward the collection chamber 28. Wash liquid 16, containing food particles, that does not flow through the fine filter 26 flows into the collection chamber, where the food particles are collected. Wash liquid from the collection chamber 28 can be filtered and flow into the pump chamber 30 or can remain in the collection chamber 28.

When the wash operation is completed, the solenoid 64 moves the diverter valve 60 to a drain position (shown in solid lines in FIG. 1). The pump 34 forces wash liquid from the pump chamber 30 through the U-pipe 45 to the venturi 42. The solenoid is operated momentarily and then the flow of water from the pump chamber 30 maintains the valve 60 in the drain position against the force of the spring 62. The flow of wash liquid through the venturi 42 entrains wash liquid in the collection chamber 28 through the suction gap 58. The entrained wash liquid carries food particles from the collection chamber 28 through the diffuser 54 to the drain pipe 48. Draining continues until the liquid level in the pump chamber 30 is below the pump mouth 33 and, preferably, the collection chamber 28 is substantially empty. The collection chamber 28 is emptied because the mouth 33 is below the level of the bottom wall 37, thus, suction is maintained until all liquid has been entrained from the collection chamber or flowed from the collection chamber into the pump chamber 30. Substantially all of the food particles in the collection chamber are thereby discharged from the dishwasher 10. Suction of the pump is abruptly broken when the liquid level falls below the mouth 33 level because the mouth is substantially horizontal. The diverter valve 60 is returned to the recirculating position by the spring 62 for a subsequent wash cycle. The abrupt breaking of suction maximizes evacuation of the pump chamber 30 against the back pressure of the drain pipe 48 and drain. This prevents a substantial amount of liquid from remaining in the pump 34, thereby reducing the likelihood that the diverter valve 60 will stick in the drain position.

The present disclosure describes several embodiments of the invention, however, the invention is not limited to these embodiments. Other variations are contemplated to be within the spirit and scope of the invention and appended claims.

What is claimed is:

1. A washer, comprising:

a washing chamber adapted for containing objects to be washed;

a sump in connection with the washing chamber and adapted for collecting washing liquid from the washing chamber;

a pump in communication with the sump;

a drain conduit communicable with a drain;

a delivery conduit adapted for spraying washing liquid into the washing chamber;

a diverter valve for diverting washing liquid from the pump to a selected one of the drain conduit and delivery conduit, wherein the diverter valve is biased to divert washing liquid to the delivery conduit and movable to a drain position for diverting washing liquid to the drain conduit;

an operator connected to move the valve to the drain position, wherein the operator is activated momentarily and deactivated so that liquid flowing past the valve maintains the valve in the drain position; and an inlet of the pump having a generally horizontal mouth disposed in a lower part of the sump at a location below the pump.

2. A washer according to claim 1, wherein the inlet includes a downwardly directed suction pipe.

3. A washer according to claim 2, wherein the mouth is a bell mouth.

4. A washer according to claim 2, wherein the inlet is in disposed in a generally vertical plane.

5. A washer according to claim 4, wherein the suction pipe includes an elbow.

6. A washer according to claim 1, further comprising a spring for biasing the valve.

7. A washer according to claim 1, wherein the valve is a flapper valve.

8. A washer according to claim 1, wherein water pressure created by the pump seals the valve.

9. A washer according to claim 1, wherein the valve comprises a flapper movable to the drain position and the operator is activated momentarily to move the flapper to the drain position.

10. A washer according to claim 9, wherein liquid flowing past the flapper maintains the flapper engaged with the lip so as to close the delivery inlet when the operator is deactivated.

11. A washer according to claim 10, further comprising a spring connected to apply a force against the flapper so as to bias the flapper away from the drain position.

12. A washer according to claim 10, wherein the delivery conduit includes a delivery inlet having a lip and an end of the flapper engages the lip so as to close the delivery inlet in the drain position.

13. A washer according to claim 10, wherein the drain conduit includes a drain inlet, and the flapper is movable to a recirculate position wherein the flapper closes the drain inlet.

14. A washer according to claim 13, further comprising a spring connected to apply a force against the flapper so as to bias the flapper toward the recirculate position.

15. A washer according to claim 1, wherein the delivery conduit includes a delivery inlet having a lip, the drain conduit includes a drain inlet, and the valve comprises a flapper movable to the drain position wherein an end of the flapper engages the lip so as to close the delivery inlet and movable to a recirculate position wherein the flapper closes the drain inlet, further comprising a spring connected to apply a force against the flapper so as to bias the flapper toward the recirculate position, wherein the operator is a solenoid that is activated momentarily to move the flapper to the drain position and deactivated so that liquid flowing past the flapper maintains the flapper engaged with the lip so as to close the delivery inlet.

* * * * *